US005725484A

United States Patent [19]

Burnham

[11] Patent Number: 5,725,484

[45] Date of Patent: Mar. 10, 1998

[54] MANUAL PERSONAL MASSAGER

[76] Inventor: Bruce Stanwood Burnham, 600 Merrimon Ave., apt. 6-H, Asheville, N.C. 28804

[21] Appl. No.: 596,606

[22] Filed: Feb. 5, 1996

[51] Int. Cl.[6] ..... A61H 15/00

[52] U.S. Cl. ..... 601/128; 601/129; 601/131; 601/132; 601/134

[58] Field of Search ..... 601/128, 129, 601/131, 132, 113, 115, 120, 122, 24, 27, 84, 99, 90, 134

[56] References Cited

U.S. PATENT DOCUMENTS

| | | | |
|---|---|---|---|
| 662,083 | 11/1900 | McFadden | 601/132 |
| 681,331 | 8/1901 | Milkman | 601/128 |
| 2,183,726 | 12/1939 | Sommer et al. | 601/128 |
| 2,227,724 | 1/1941 | Kosa, Sr. | 601/132 |
| 4,210,135 | 7/1980 | Deuser | 601/118 |
| 4,577,625 | 3/1986 | Lohati et al. . | |
| 4,936,294 | 6/1990 | Chu | 601/136 |
| 5,105,490 | 4/1992 | Shek | 601/134 |
| 5,251,615 | 10/1993 | Sheen | 601/115 |
| 5,531,665 | 7/1996 | Chen | 601/118 |
| 5,545,456 | 8/1996 | Suida | 601/113 |

FOREIGN PATENT DOCUMENTS

| | | | |
|---|---|---|---|
| 565508 | 1/1924 | France | 601/132 |
| 2218878 | 10/1973 | Germany | 601/128 |
| 1641335 | 4/1991 | U.S.S.R. | 601/132 |

*Primary Examiner*—Robert A. Hafer
*Assistant Examiner*—Justine Yu
*Attorney, Agent, or Firm*—Michael I. Kroll

[57] ABSTRACT

A manual personal massager (10) comprising a pair of handles (12) to be gripped by the hand (14) of a person (16). A web network grid (18) is provided. A facility (20) is for attaching opposite ends of the web network grid (18) to the pair of handles (12). A plurality of massaging members (22) are carried in the web network grid (18) to be applied to a body part (24) of a person (16) and moved back and forth by the movement of the pair of handles (12).

18 Claims, 2 Drawing Sheets

MANUAL PERSONAL MASSAGER

BACKGROUND OF THE INVENTION

1. Field of the Invention

The instant invention relates generally to massaging devices and more specifically it relates to a manual personal massager.

2. Description of the Prior Art

Numerous massaging devices have been provided in prior art. For example, U.S. Pat. Nos. 681,331 to Milkman; 2,183,726 to Sommer et al.; 4,210,135 to Deuser and 4,577,625 to Lohati et al. all are illustrative of such prior art. While these units may be suitable for the particular purpose to which they address, they would not be as suitable for the purposes of the present invention as heretofore described.

MILKMAN, GEORGE W.

COMBINATION MASSAGE ROLLER AND EXERCISER

U.S. Pat. No. 681,331

As an improvement in massage or exercising devices of the class set forth. A handle member comprising an inner cross-piece forms a handhold and carries positively in predetermined fixed relative arrangement an outwardly-projecting frame embodying an outer cross-piece upon which are mounted rollers. The outer cross member and its rollers constitute an outer handle or handhold. The inner crosspiece or handhold is provided with means for attachment or connection with the body of a massage or exercising device.

SOMMER, VICTOR

ROBERTS, BRUNO R.

FAUST, FRITZ M.

APPARATUS FOR THE TREATMENT OF THE SKIN OR THE LIKE

U.S. Pat. No. 2,183,726

An apparatus for the treatment of the skin or the like, comprising a housing forming a handle. A removable head is for the housing. A translucent partition is in the head. A device within the housing is for emitting heat and light to the skin. A reservoir in the head is for holding skin treating matter. The partition forms a wall of the reservoir. The surface of the head is provided with means for discharging the matter and massaging the same into the skin, while the skin is under heat and light treatment through the device.

DEUSER, ERICH

MASSAGING DEVICE

U.S. Pat. No. 4,210,135

A plurality of non-rotating disc-shaped massaging members are fixed on a flexible shaft held at its ends by a bow. Spherical rolling members between the massaging members space the massaging members apart and limit their depth of depression into the skin.

LOHATI, ALADAR

LOHATI, GIZELLA

ROTATING BALL MASSAGER

U.S. Pat. No. 4,577,625

An improved rotating ball massager that allows an individual to manually massage oneself or another person. The massager is configured in the form of a flexible mitten. The mitten has attached around its side edges a side strip having a plurality of slots, cut along its length, into which is inserted a cross-joint. To the vertical tube section of each cross-joint set is attached a rotating circular bead assembly. The assembly includes a plurality of rotatable knurled beads that extend across the width of the mitten. When the mitten is moved back-and-forth under pressure of the hand against a skin surface, the rotating beads impart a soothing affect to tired and aching muscles. The massager can also be used in combination with an electric vibrator and/or a heating element. These additional implements further add to the relief of aches and the therapeutic effects provided by the massager.

SUMMARY OF THE INVENTION

A primary object of the present invention is to provide a manual personal massager that will overcome the shortcomings of the prior art devices.

Another object is to provide a manual personal massager in which the user can control the amount of pressure needed to massage nearly any body part by moving the massaging members back and forth.

An additional object is to provide a manual personal massager in which the massaging members are balls that can be of varying materials and shapes, so as to customize the massaging effect upon the body parts to be massaged.

A further object is to provide a manual personal massager that is simple and easy to use.

A still further object is to provide a manual personal massager that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of a first embodiment of the instant invention being used in massaging the bottom of a foot.

FIG. 1*a* is a perspective view of a portion of a second embodiment of the instant invention.

FIG. 1*b* is a side view taken in the direction of arrow 1*b* in FIG. 1*a*, with parts broken away and in section.

FIG. 1*c* is a side view taken in the direction of arrow 1*c* in FIG. 1, with parts broken away and in section.

Similar reference characters denote corresponding features consistently throughout the attached drawings.

DETAILED DESCRIPTION OF THE PREFERRED EMBODIMENTS

Figure 1:
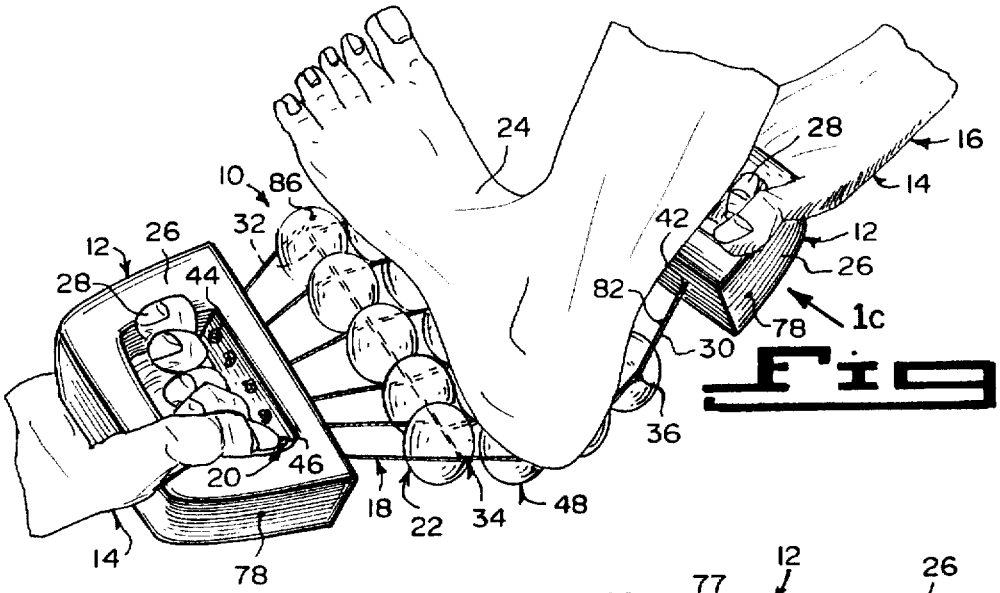

Turning now descriptively to the drawings, in which similar reference characters denote similar elements throughout the several views, FIGS. 1 through 6 illustrate a manual personal massager 10 comprising a pair of handles 12, to be gripped by the hands 14 of a person 16. A web network grid 18 is provided. A facility 20 is for attaching opposite ends of the web network grid 18 to the pair of handles 12. A plurality of massaging members 22 are carried in the web network grid 18, to be applied to a body part 24 of a person 16 and moved back and forth by the movement of the pair of handles 12. The body part 24 in FIG. 1 is a foot, but other areas of the person 16 can also be massaged.

Each handle 12 is a D-shaped grip member 26 to be held by the fingers 28 of the hand 14 of the person 16. The web network grid 18 includes a plurality of longitudinal filaments 30. A plurality of transverse filaments 32 are also provided. Structures 34 are for connecting the transverse filaments 32 to the longitudinal filaments 30 in extending spaced apart parallel relationships thereacross. The connecting structures 34 can consist of a plurality of joint knots 36, or other types of suitable connectors (not shown), at junctions between the longitudinal filaments 30 and the transverse filaments 32.

Figure 1A:
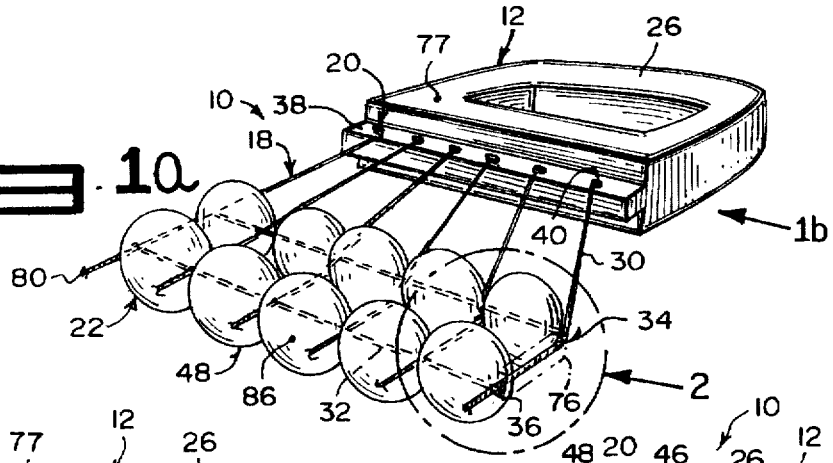
Figure 1B:
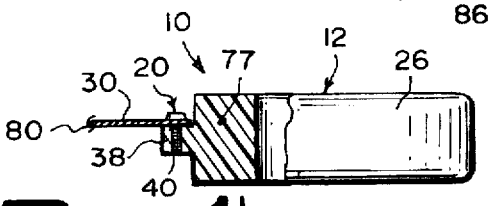
Figure 1C:
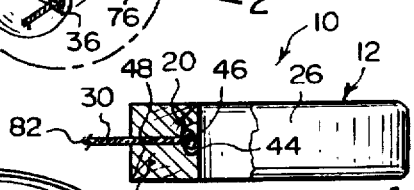
Figure 6:
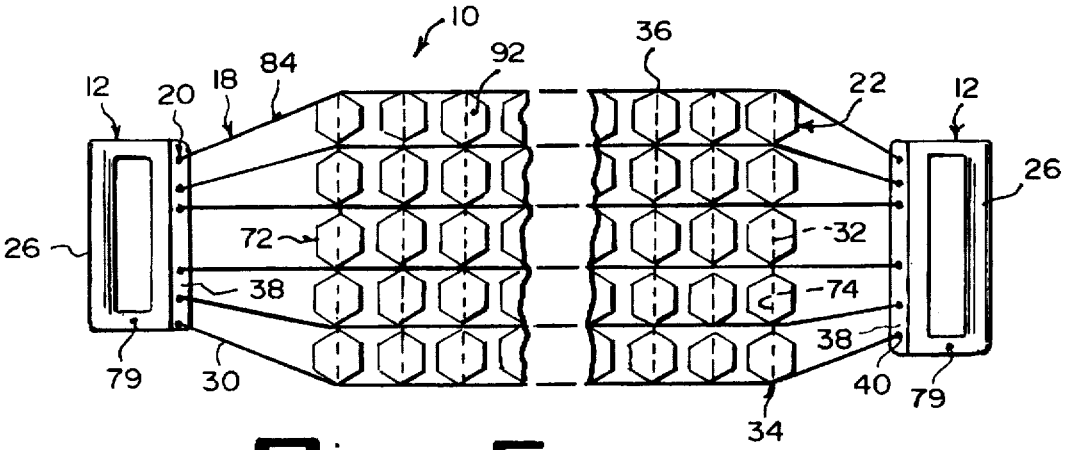
FIG. 6 is a diagrammatic top view of a third embodiment of the instant invention with parts broken away.

The attaching facility 20, as shown in FIGS. 1*a*, 1*b* and 6, consist of each handle 12 having an inner cross flange 38. A plurality of setscrews 40 are provided. Each setscrew 40 will retain one end of one longitudinal filament 30 to the inner cross flange 38. The facility 20, as shown in FIGS. 1 and 1*c*, can also include each handle 12 having a plurality of horizontal inner bores 42 with a forward recess 44. Each end of each longitudinal filament 30 can be inserted through each horizontal inner bore 42 and then knotted at 46, to be retained in the forward recess 44.

Figure 2:
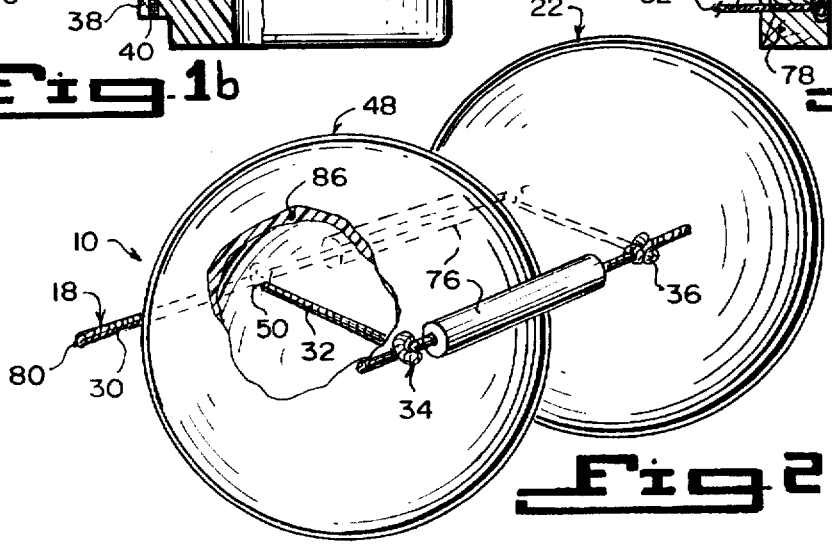
FIG. 2 is an enlarged perspective view of an area of FIG. 1*a* as indicated by arrow 2.

Each massaging member 22, shown in FIGS. 1, 1*a* and 2, is a hollow ball 48 having a central aperture 50 therethrough. The balls 48 can be strung in a rotatable manner upon the transverse filaments 32 and between the longitudinal filaments 30 in side by side relationships, to form a massage bed.

Figure 3:
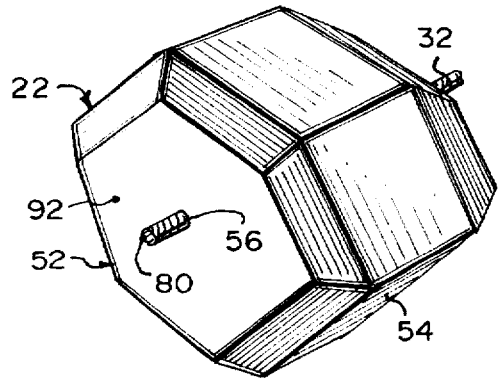
FIG. 3 is a perspective view of a second type of massaging member.

Each massaging member 22, one of which is shown in FIG. 3, is a bead 52 having multiple flat sides 54 and a central aperture 56 therethrough. The beads 52 can be strung in a rotatable manner upon the transverse filaments 32 and between the longitudinal filaments 30 in side by side relationships, to form a massage bed.

Figure 4:
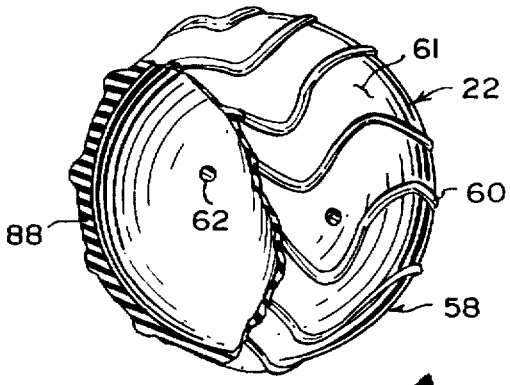
FIG. 4 is a perspective view with parts broken away and in section of a third type of massaging member.

Each massaging member 22, one of which is shown in FIG. 4, is a hollow sphere 58 having a plurality of wavy protrusions 60 on an exterior surface 61 and a central aperture 62 therethrough. The hollow spheres 58 can be strung in a rotatable manner upon the transverse filaments 32 and between the longitudinal filaments 30 in side by side relationships, to form a massage bed.

Figure 5:
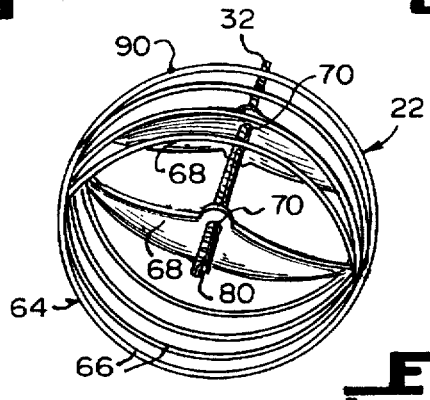
FIG. 5 is a perspective view of a fourth type of massaging member.

Each massaging member 22, one of which is shown in FIG. 5, is a ball frame 64 fabricated out of a series of rings 66 and having a pair of opposite side pieces 68 with aligned apertures 70, the ball frames 64 can be strung in a rotatable manner upon the transverse filaments 32 and between the longitudinal filaments 30 in side by side relationships, to form a massage bed.

Each massaging member 22 in FIG. 6, is a dodechedron 72 having a central aperture 74 therethrough. The dodechedrons 72 can be strung in a rotatable manner upon the transverse filaments 32 and between the longitudinal filaments 30 in side by side relationships, to form a massage bed. A plurality of sheaths 76, as shown in FIGS. 1*a* and 2, can be placed upon the longitudinal filaments 30 between the connecting structures 34, so as to stabilize the massaging members 22 in the web network grid 18.

Each handle 12, can be made out of plastic 77, wood 78 or metal 79. The web network grid 18 can be made out of metal 80, plastic 82 or cloth woven fibers 84. Each massaging member 22 can be made out of plastic 86, rubber 88, metal 90 or wood 92.

The web network grid 18 and the massaging members 22 of the manual personal massager 10 can vary in size, depending upon the needs of the person 16 using it on different body parts 24. The employment of the sheaths 76 on the longitudinal filaments 30 are optional and need only be used to stabilize the massaging members 22 in the web network grid 18 if needed.

LIST OF REFERENCE NUMBERS 10 manual personal massager
12 handle of 10
14 hand of 16
16 person
18 web network grid of 10
20 attaching facility of 10
22 massaging member of 10
24 body part of 16
26 D-shaped grip member for 12
28 finger of 14
30 longitudinal filament of 18
32 transverse filament of 18
34 connecting structure
36 joint knot of 34
38 inner cross flange on 12
40 setscrew in 38
42 inner bore in 12
44 forward recess in 12 at 42
46 knot of 30
48 hollow ball for 22
50 central aperture in 48
52 bead for 22
54 flat side of 52
56 central aperture in 52
58 hollow sphere for 22
60 wavy protrusion on 58
61 exterior surface of 58
62 central aperture in 58
64 ball frame for 22
66 ring of 64
68 side piece of 64
70 aperture in 68
72 dodecahedron for 22
74 central aperture in 72
76 sheath on 30
77 plastic of 12
78 wood of 12
79 metal of 12
80 metal of 18
82 plastic of 18
84 cloth woven fibers of 18
86 plastic of 22
88 rubber of 22
90 metal of 22
92 wood of 22

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A manual personal massager comprising:

a) a pair of handles to be gripped by the hands of a person;

b) a web network grid including:

i) a plurality of longitudinal filaments;

ii) a plurality of transverse filaments; and iii) means for connecting said transverse filaments to said longitudinal filaments in extending spaced apart parallel relationships thereacross;

c) means for attaching opposite ends of said web network grid to said pair of handles;

d) a plurality of massaging members carried in said web network grid and moved back and forth by the movement of said pair of handles; and e) a plurality of sheaths placed upon said longitudinal filaments between said connecting means, so as to stabilize said massaging members in said web network grid.

2. A manual personal massager as recited in claim 1, wherein said connecting means includes a plurality of joint knots at junctions between said longitudinal filaments and said transverse filaments.

3. A manual personal massager as recited in claim 1, wherein said attaching means includes:

a) each said handle having an inner cross flange; and b) a plurality of setscrews, in which each said setscrew will retain one end of one longitudinal filament to said inner cross flange.

4. A manual personal massager as recited in claim 1, wherein said attaching means includes each said handle having a plurality of horizontal inner bores with a forward recess, so that each end of each longitudinal filament can be inserted through each said horizontal inner bore and then knotted to be retained in said forward recess.

5. A manual personal massager as recited in claim 1, wherein each said massaging member is a hollow ball having a central aperture therethrough, so that said balls can be strung in a rotatable manner upon said transverse filaments and between said longitudinal filaments in side by side relationships, to form a massage surface.

6. A manual personal massager as recited in claim 1, wherein each said massaging member is a bead having multiple flat sides and a central aperture therethrough, so that said beads can be strung in a rotatable manner upon said transverse filaments and between said longitudinal filaments in side by side relationships, to form a massage surface.

7. A manual personal massager as recited in claim 1, wherein each said massaging member is a hollow sphere having a plurality of wavy protrusions on an exterior surface and a central aperture therethrough, so that said hollow spheres can be strung in a rotatable manner upon said transverse filaments and between said longitudinal filaments in side by side relationships, to form a massage surface.

8. A manual personal massager as recited in claim 1, wherein each said massaging member is a ball frame fabricated out of a series of rings and having a pair of opposite side pieces with aligned apertures, so that said ball frames can be strung in a rotatable manner upon said transverse filaments and between said longitudinal filaments in side by side relationships, to form a massage surface.

9. A manual personal massager as recited in claim 1, wherein each said massaging member is a dodecahedron having a central aperture therethrough, so that said dodecahedrons can be strung in a rotatable manner upon said transverse filaments and between said longitudinal filaments in side by side relationships, to form a massage surface.

10. A manual personal massager as recited in claim 1, wherein each said handle is a D-shaped grip member.

11. A manual personal massager as recited in claim 10, wherein said connecting means includes a plurality of joint knots at junctions between said longitudinal filaments and said transverse filaments.

12. A manual personal massager as recited in claim 11, wherein said attaching means includes:

a) each said handle having an inner cross flange; and b) a plurality of setscrews, in which each said setscrew will retain one end of one longitudinal filament to said inner cross flange.

13. A manual personal massager as recited in claim 11, wherein said attaching means includes each said handle having a plurality of horizontal inner bores with a forward recess, so that each end of each longitudinal filament can be inserted through each said horizontal inner bore and then knotted to be retained in said forward recess.

14. A manual personal massager as recited in claim 11, wherein each said massaging member is a hollow ball having a central aperture therethrough, so that said balls can be strung in a rotatable manner upon said transverse filaments and between said longitudinal filaments in side by side relationships, to form a massage surface.

15. A manual personal massager as recited in claim 11, wherein each said massaging member is a bead having multiple flat sides and a central aperture therethrough, so that said beads can be strung in a rotatable manner upon said transverse filaments and between said longitudinal filaments in side by side relationships, to form a massage surface.

16. A manual personal massager as recited in claim 11, wherein each said massaging member is a hollow sphere having a plurality of wavy protrusions on an exterior surface and a central aperture therethrough, so that said hollow spheres can be strung in a rotatable manner upon said transverse filaments and between said longitudinal filaments in side by side relationships, to form a massage surface.

17. A manual personal massager as recited in claim 11, wherein each said massaging member is a ball frame fabricated out of a series of rings and having a pair of opposite side pieces with aligned apertures, so that said ball frames can be strung in a rotatable manner upon said transverse filaments and between said longitudinal filaments in side by side relationships, to form a massage surface.

18. A manual personal massager as recited in claim 11, wherein each said massaging member is a dodecahedron having a central aperture therethrough, so that said dodecahedrons can be strung in a rotatable manner upon said transverse filaments and between said longitudinal filaments in side by side relationships, to form a massage surface.

* * * * *